US006914590B2

(12) United States Patent
Yoo et al.

(10) Patent No.: US 6,914,590 B2
(45) Date of Patent: Jul. 5, 2005

(54) METHOD OF DRIVING ANTI-FERROELECTRIC LIQUID CRYSTAL DISPLAY PANEL FOR EQUALIZING TRANSMITTANCE OF THE PANEL

(75) Inventors: Jeong-guen Yoo, Gunpo (KR); Sung-chon Park, Anyang (KR)

(73) Assignee: Samsung SDI Co., Ltd., Suwon (KR)

( * ) Notice: Subject to any disclaimer, the term of this patent is extended or adjusted under 35 U.S.C. 154(b) by 312 days.

(21) Appl. No.: 10/193,200

(22) Filed: Jul. 12, 2002

(65) Prior Publication Data

US 2003/0063060 A1 Apr. 3, 2003

(30) Foreign Application Priority Data

Sep. 29, 2001 (KR) ..... 2001-60976

(51) Int. Cl.[7] ..... G09G 3/36

(52) U.S. Cl. ..... 345/97; 345/96; 345/209

(58) Field of Search ..... 345/87, 94–100, 345/204, 208–210, 60–68; 349/174

(56) References Cited

U.S. PATENT DOCUMENTS 5,459,481 A * 10/1995 Tanaka et al. ..... 345/95
5,973,659 A * 10/1999 Kondoh ..... 345/97
6,008,787 A * 12/1999 Kondoh ..... 345/97
6,509,887 B1 * 1/2003 Kondoh et al. ..... 345/87

* cited by examiner

*Primary Examiner*—Regina Liang
(74) *Attorney, Agent, or Firm*—McGuireWoods LLP

(57) ABSTRACT

A method of driving an anti-ferroelectric liquid crystal display (LCD) panel is provided that provides uniform transmittance display characteristics. In the anti-ferroelectric LCD panel, signal electrode lines are arranged in parallel above anti-ferroelectric liquid crystal cells, and at least first and second scan electrode lines are arranged below the anti-ferroelectric liquid crystal cells perpendicular to the signal electrode lines. The method includes a first driving step and a second driving step, which are repeated. Each of the first and second driving steps includes a scanning step, an inversion step, and an iteration step. In the scanning step, a scan selection voltage is applied to the first scan electrode line, and simultaneously, display data signals are applied to the signal electrode lines. In the inversion step, a sustain voltage is applied to the first scan electrode line, and simultaneously, inverted signals of the display data signals which have been applied during the scanning step are applied to the signal electrode lines. In the iteration step, the scanning and inversion steps are repeatedly performed with respect to the second scan electrode line and all of the signal electrode lines.

16 Claims, 6 Drawing Sheets

METHOD OF DRIVING ANTI-FERROELECTRIC LIQUID CRYSTAL DISPLAY PANEL FOR EQUALIZING TRANSMITTANCE OF THE PANEL

BACKGROUND OF THE INVENTION

1. Field of the Invention

The present invention relates to a method of driving an anti-ferroelectric liquid crystal display (LCD) panel, and more particularly, to a method for driving an anti-ferroelectric LCD panel having signal electrode lines arranged in parallel above anti-ferroelectric liquid crystal cells, and scan electrode lines arranged in parallel below the anti-ferroelectric liquid crystal cells, perpendicular to the signal electrode lines.

2. Description of the Related Art

Referring to FIG. 1, a general anti-ferroelectric liquid crystal display apparatus 1 includes an anti-ferroelectric LCD panel 11 and a driving unit.

In the anti-ferroelectric LCD panel 11, signal electrode lines SL1, SL2, SL3, . . . , SLm are arranged in parallel above anti-ferroelectric liquid crystal cells LC, and scan electrode lines CL1, CL2, CL3, . . . , CLn are arranged below the anti-ferroelectric liquid crystal cells LC, perpendicular to the signal electrode lines SL1, SL2, SL3, . . . , SLm. The scan electrode lines CL1, CL2, CL3, . . . , CLn and the signal electrode lines SL1, SL2, SL3, . . . , SLm are formed from a transparent conductor, such as, indium-tin-oxide (ITO).

The driving unit includes a controller 14, a segment driver 12, a modulation signal generator 131, and a common driver 132. The controller 14 processes a video signal Sc received from a host, for example, a notebook computer, and generates a data signal 'DATA,' a shift clock signal 'SCK,' a frame signal 'FLM,' and a latch clock signal 'LCK.' The segment driver 12 holds the data signal DATA for the individual signal electrode lines SL1, SL2, SL3, . . . , SLm according to the shift clock signal SCK. In addition, the segment driver 12 applies a signal voltage corresponding to the waiting data signal DATA to the individual signal electrode lines SL1, SL2, SL3, . . . , SLm according to the latch clock signal LCK.

The frame signal FLM indicates the start of a single frame. The modulation signal generator 131 divides the frequency of the latch clock signal LCK to generate a modulation signal. The generated modulation signal controls the polarities of the respective output voltages of the segment driver 12 and the common driver 132.

The common driver 132 sequentially applies a scan voltage to the scan electrode lines CL1, CL2, CL3, . . . , CLn according to the latch clock signal LCK, the frame signal FLM, and the modulation signal. In this manner, light is transmitted through or blocked by individual anti-ferroelectric liquid crystal cells LC in the array.

FIG. 2 shows the relationship between voltages +V and −V applied to the anti-ferroelectric liquid crystal cells LC and transmittance for light in the apparatus shown in FIG. 1.

Referring to FIG. 2, when a ground voltage VG is applied to the anti-ferroelectric liquid crystal cells LC, the anti-ferroelectric liquid crystal cells LC go into an anti-ferroelectric state. In this state, if an applied voltage gradually increases in the positive (+) direction, the anti-ferroelectric liquid crystal cells LC are converted into a positive ferroelectric state at a positive second threshold voltage +Vth2. Then, external light starts to be transmitted through the anti-ferroelectric liquid crystal cells LC (see the direction denoted by D1). Next, if the positive voltage +V gradually decreases, the positive ferroelectric state is maintained, and the transmission of light continues until the voltage reaches a positive first threshold voltage +Vth1 (see the direction denoted by D2). Next, when the positive voltage +V becomes lower than the positive first threshold voltage +Vth1, the anti-ferroelectric liquid crystal cells LC are restored to an anti-ferroelectric state, thereby blocking the external light.

When a voltage applied to the anti-ferroelectric liquid crystal cells LC gradually increases from a ground voltage VG in the negative (−) direction, the anti-ferroelectric liquid crystal cells LC are converted into a negative ferroelectric state at a negative second threshold voltage −Vth2. At this point, external light starts to be transmitted through the anti-ferroelectric liquid crystal cells LC (see the direction denoted by D3). Next, if the negative voltage −V gradually decreases, the negative ferroelectric state is maintained, and the transmission of light continues until the negative voltage −V reaches a negative first threshold voltage −Vth1 (see the direction denoted by D4). Next, when the negative voltage −V becomes lower than the negative first threshold voltage −Vth1, the anti-ferroelectric liquid crystal cells LC are restored to an anti-ferroelectric state, thereby blocking external light.

FIG. 3 shows the voltage waveforms of scan signals SC1, SC2, . . . , SCn, SC1', SC2', . . . , SCn' sequentially applied to the scan electrode lines CL1, CL2, CL3, . . . , CLn of FIG. 1, and the voltage waveforms of display data signals SS1, SS2, . . . , SSn, SS1', SS2', . . . , SSn' simultaneously applied to the signal electrode lines SL1, SL2, SL3, . . . , SLm of FIG. 1, according to a conventional driving method. In FIG. 3, the reference character S1 denotes a waveform diagram for a first scan electrode line CL1, the reference character S2 denotes a waveform diagram for a second scan electrode line CL2, and the reference character Sn denotes a waveform diagram for an n-th scan electrode line CLn.

Referring to FIG. 3, during a first driving step, a first scan selection voltage VCH is sequentially applied to the scan electrode lines CL1, CL2, CL3, . . . , CLn, and simultaneously first display data signals SS1, SS2, . . . , SSn, having voltages VSH and VSL lower than the first scan selection voltage VCH, are applied to the signal electrode lines SL1, SL2, SL3, . . . , SLm. In addition, while scan is not performed (for example, periods t2 through tn in the waveform diagram S1), a first sustain voltage VCM1 lower than the first scan selection voltage VCH and higher than the voltages of the first display data signals SS1, SS2, . . . , SSn is applied to a relevant one among the scan electrode lines CL1, CL2, CL3, . . . , CLn.

Accordingly, when the first scan selection voltage VCH is applied to one scan electrode line and the selection data voltage VSL is applied to selected signal electrode lines, selected anti-ferroelectric liquid crystal cells LC (shown in FIG. 1) are converted into a positive ferroelectric state. Accordingly, external light begins to be transmitted (refer to the operation corresponding to the D1 direction of FIG. 2) through the selected anti-ferroelectric liquid crystal cells LC. Next, the first sustain voltage VCM1 is applied to the scan electrode line, so the selected anti-ferroelectric liquid crystal cells LC are maintained in the positive ferroelectric state, thereby continuously transmitting light (refer to the operation corresponding to the D2 direction of FIG. 2).

In a second driving step, a second scan selection voltage VCL is sequentially applied to the scan electrode lines CL1, CL2, CL3, . . . , CLn, and simultaneously second display data signals SS1', SS2', . . . , SSn' having voltages VSH and VSL, which have a lower negative level than the second scan selection voltage VCL, are applied to the signal electrode lines SL1, SL2, SL3, . . . , SLm. In addition, while scan is not performed (for example, periods t2' through tn' in the waveform diagram S1), a second sustain voltage VCM2, having a lower negative level than the second scan selection voltage VCL and a higher level than the voltages of the second display data signals SS1', SS2', . . . SSn,' is applied to a relevant one among the scan electrode lines CL1, CL2, CL3, . . . , CLn.

Accordingly, when the second scan selection voltage VCL is applied to one scan electrode line and the selection data voltage VSH is applied to selected signal electrode lines, selected anti-ferroelectric liquid crystal cells LC are converted into a negative ferroelectric state. Accordingly, external light begins to be transmitted (refer to the operation corresponding to the D3 direction of FIG. 2) through the selected anti-ferroelectric liquid crystal cells LC. Next, the second sustain voltage VCM2 is applied to the scan electrode line, so the selected anti-ferroelectric liquid crystal cells LC are maintained in the negative ferroelectric state, thereby continuously transmitting the light (refer to the operation corresponding to the D4 direction of FIG. 2).

According to such conventional method of driving an anti-ferroelectric liquid crystal display panel, the levels of voltages (VA and VB of FIG. 4) applied for maintaining the selected states of anti-ferroelectric liquid crystal cells LC on one scan electrode line change depending on the display data signals SS1, SS2, . . . , SSn, SS1', SS2', . . . , SSn,' while the scan selection voltages VCH and VCL are being applied to the other scan electrode lines. FIG. 4 shows the waveforms of voltages applied to two anti-ferroelectric liquid crystal cells LC on one scan electrode line according to the driving method shown in FIG. 3. In FIG. 4, the reference character VW1 denotes the voltage waveform applied to a first anti-ferroelectric liquid crystal cell LC, and the reference character VW2 denotes the voltage waveform applied to a second anti-ferroelectric liquid crystal cell LC on a scan electrode line. In FIG. 4, it is assumed that a first anti-ferroelectric LCD panel 11 of FIG. 1 is provided with only five scan electrode lines CL1 through CL5. In addition, it is assumed that the first anti-ferroelectric liquid crystal cell LC is defined by the first scan electrode line CL1 and a first signal electrode line SL1, and the second anti-ferroelectric liquid crystal cell LC is defined by the first scan electrode line CL1 and a second signal electrode line SL2.

Referring to FIG. 4, a voltage applied to the first and second anti-ferroelectric liquid crystal cells LC, which are turned ON during a first scan time t1 of a first frame, has a level VCH+VSL equal to the sum of the level of the first scan selection voltage VCH of FIG. 3 and the level of the logic low voltage VSL of the display data signal. During a following sustain period ranging from a scan time t2 to a scan time t5, while the first scan selection voltage VCH is applied to the other scan electrode lines CL2 through CL5, the voltage applied to the first anti-ferroelectric liquid crystal cell LC has a level VA equal to the sum of the level of the first sustain voltage VCM1 and the level of the logic low voltage VSL, if the logic low voltage VSL is applied to the first signal electrode line SL1, and has a level VB equal to a difference between the level of the first sustain voltage VCM1 and the level of the logic high voltage VSH, if the logic high voltage VSH is applied to the first signal electrode line SL1. Accordingly, during the sustain period ranging from t2 to t5, the voltage applied to the first anti-ferroelectric liquid crystal cell LC is constant at the level VA equal to the sum of the level of the first sustain voltage VCM1 and the level of the logic low voltage VSL, if the logic low voltage VSL is applied to the first signal electrode line SL1, while the first scan selection voltage VCH is applied to the other scan electrode lines CL2 through CL5, as shown in FIG. 4 (see the waveform VW1).

Meanwhile, during the sustain period ranging from t2 to t5 following the first scan time t1 in the first frame, while the first scan selection voltage VCH is applied to the other scan electrode lines CL2 through CL5, a voltage applied to the second anti-ferroelectric liquid crystal cell LC has a level VA equal to the sum of the level of the first sustain voltage VCM1, and the level of the logic low voltage VSL, if the logic low voltage VSL is applied to the second signal electrode line SL2, and has a level VB equal to a difference between the level of the first sustain voltage VCM1 and the level of the logic high voltage VSH, if the logic high voltage VSH is applied to the second signal electrode line SL2. Accordingly, the voltage applied to the second anti-ferroelectric liquid crystal cell LC has the value VA equal to the sum of the level of the first sustain voltage VCM1 and the level of the logic low voltage VSL during the second, fourth, and fifth scan times t2, t4, and t5, if anti-ferroelectric liquid crystal cells LC scanned during the second, fourth, and fifth scan times t2, t4, and t5 among anti-ferroelectric liquid crystal cells LC on the second signal electrode line SL2 are turned ON, as shown in FIG. 4. However, the voltage applied to the second anti-ferroelectric liquid crystal cell LC has the value VB equal to a difference between the level of the first sustain voltage VCM1 and the level of the logic high voltage VSH during the third scan time t3, if anti-ferroelectric liquid crystal cells LC scanned during the third scan time t3 among anti-ferroelectric liquid crystal cells LC on the second signal electrode line SL2 are turned OFF, as shown in FIG. 4 (see the waveform VW2).

During a first scan time t1' of a second frame, the voltages applied to the respective first and second anti-ferroelectric liquid crystal cells LC which are turned ON has a level VCL+VSH which is the sum of the level of the second scan selection voltage VCL of FIG. 3 and the level of the logic high voltage VSH of the display data signal. During a sustain period ranging from a second scan time t2' to a fifth scan time t5', while the second scan selection voltage VCL is applied to the other scan electrode lines CL2 through CL5, the voltage applied to the first anti-ferroelectric liquid crystal cell LC has a level VA equal to the sum of the level of the second sustain voltage VCM2 and the level of the logic high voltage VSH, if the logic high voltage VSH is applied to the first signal electrode line SL1, and has a level VB equal to a difference between the level of the second sustain voltage VCM2 and the level of the logic low voltage VSL, if the logic low voltage VSL is applied to the first signal electrode line SL1. Accordingly, during the sustain period ranging from t2' to t5', the voltage applied to the first anti-ferroelectric liquid crystal cell LC is constant at the level VA equal to the sum of the level of the second sustain voltage VCM2 and the level of the logic high voltage VSH, if the logic high voltage VSH is applied to the first signal electrode line SL1, while the second scan selection voltage VCL is applied to the other scan electrode lines CL2 through CL5, as shown in FIG. 4 (see the waveform VW1).

Meanwhile, during the sustain period ranging from t2' to t5' following the first scan time t1' in the second frame, while the second scan selection voltage VCL is applied to the other scan electrode lines CL2 through CL5, a voltage applied to the second anti-ferroelectric liquid crystal cell LC has a level VA equal to the sum of the level of the second sustain voltage VCM2 and the level of the logic high voltage VSH, if the logic high voltage VSH is applied to the second signal electrode line SL2, and has a level VB equal to a difference between the level of the second sustain voltage VCM2 and the level of the logic low voltage VSL, if the logic low voltage VSL is applied to the second signal electrode line SL2. Accordingly, the voltage applied to the second anti-ferroelectric liquid crystal cell LC has the value VA equal to the sum of the level of the second sustain voltage VCM2 and the level of the logic high voltage VSH during the second, fourth, and fifth scan times t2', t4', and t5,' if anti-ferroelectric liquid crystal cells LC scanned during the second, fourth, and fifth scan times t2', t4', and t5' among anti-ferroelectric liquid crystal cells LC on the second signal electrode line SL2 are turned ON, as shown in FIG. 4. However, the voltage applied to the second anti-ferroelectric liquid crystal cell LC has the value VB equal to a difference between the level of the second sustain voltage VCM2 and the level of the logic low voltage VSL during the third scan time t3,' if anti-ferroelectric liquid crystal cells LC scanned during the third scan time t3' among anti-ferroelectric liquid crystal cells LC on the second signal electrode line SL2 are turned OFF, as shown in FIG. 4 (see the waveform VW2).

In the above-described conventional driving method, the average level of sustain voltages applied to individual selected anti-ferroelectric liquid crystal cells LC changes, which results in different transmittance. Accordingly, the display characteristics are not uniform.

SUMMARY OF THE INVENTION

To solve the above-described problems, it is an object of the present invention to provide a method of driving an anti-ferroelectric LCD panel, in which the average level of sustain voltages applied to individual selected anti-ferroelectric liquid crystal cells is constant so that display characteristics can have uniform transmittance.

To achieve the above object of the present invention, there is provided a method of driving an anti-ferroelectric LCD panel in which signal electrode lines are arranged in parallel above anti-ferroelectric liquid crystal cells and at least first and second scan electrode lines are arranged below the anti-ferroelectric liquid crystal cells, perpendicular to the signal electrode lines. The method includes a first driving step and a second driving step, which are repeated. Each of the first and second driving steps includes a scanning step, an inversion step, and an iteration step. In the scanning step, a scan selection voltage is applied to the first scan electrode line, and simultaneously, display data signals are applied to the signal electrode lines. In the inversion step, a sustain voltage is applied to the first scan electrode line, and simultaneously, inverted signals of the display data signals, which have been applied during the scanning step, are applied to the signal electrode lines. In the iteration step, the scanning and inversion steps are repeatedly performed with respect to the second scan electrode line and all of the signal electrode lines.

According to the present invention, during an inversion step, the inverted signals of display data signals are applied to signal electrode lines, so the average level of sustain voltages applied to selected anti-ferroelectric liquid crystal cells is constant. Accordingly, display characteristics of uniform transmittance can be obtained.

Accordingly, since the state of anti-ferroelectric liquid crystal cells selected during the first driving step is inverted at the beginning of the second driving step, the degree of state conversion of the anti-ferroelectric liquid crystal cells increases in the second driving step so that the reliability of selection of the anti-ferroelectric liquid crystal cells can be increased.

BRIEF DESCRIPTION OF THE DRAWINGS

The above objects and advantages of the present invention will become more apparent by describing in detail a preferred embodiment thereof with reference to the attached drawings, in which.

DETAILED DESCRIPTION OF THE INVENTION

Figure 1:
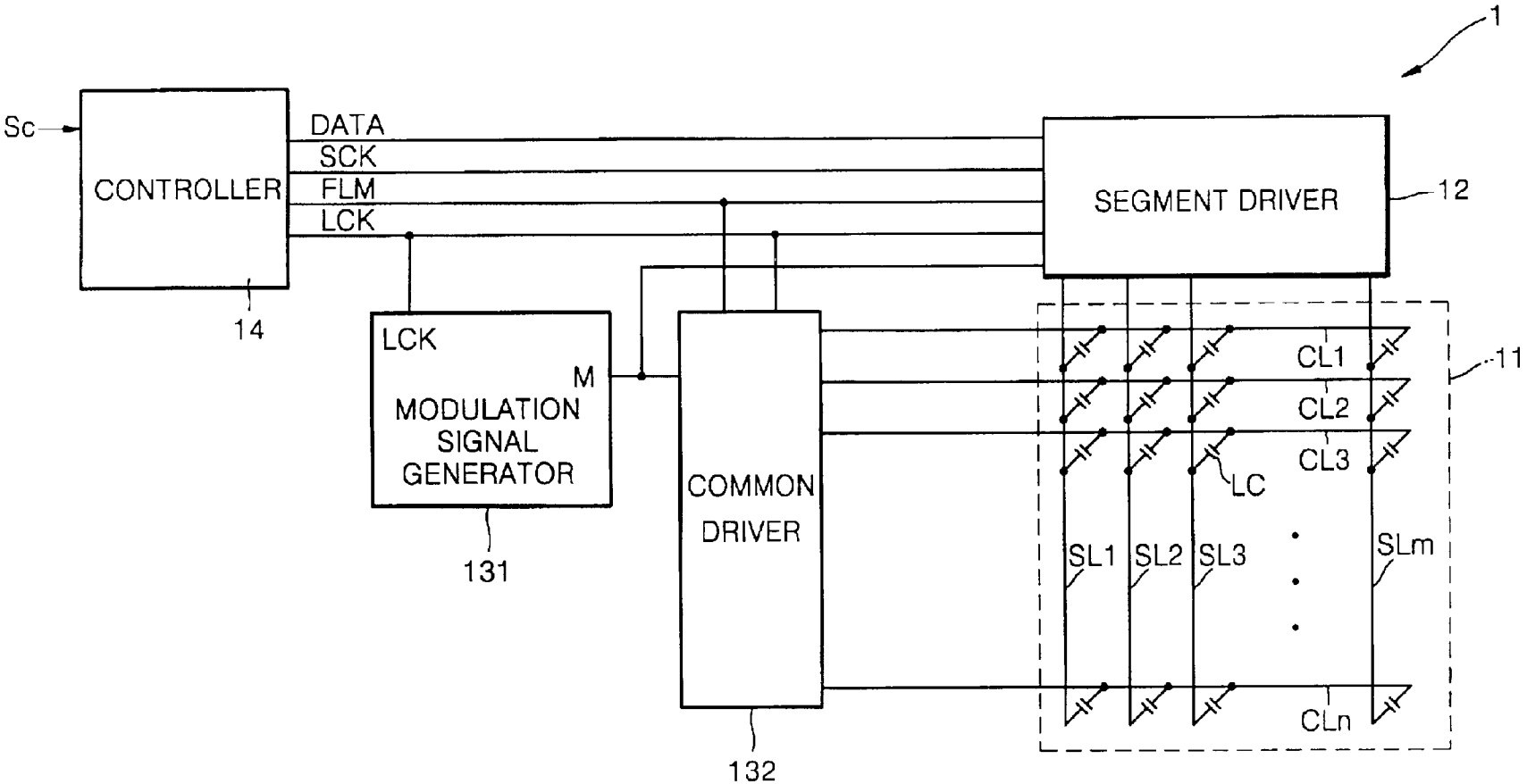
FIG. 1 (PRIOR ART)
FIG. 1 is a block diagram of a conventional anti-ferroelectric LCD apparatus.

In an anti-ferroelectric LCD panel to which an embodiment of the present invention is applied, signal electrode lines SL1 through SLm of FIG. 1 are arranged in parallel above anti-ferroelectric liquid crystal cells LC, and scan electrode lines CL1 through CLn are arranged below the anti-ferroelectric liquid crystal cells LC perpendicular to the signal electrode lines SL1 through SLm.

Figure 3:
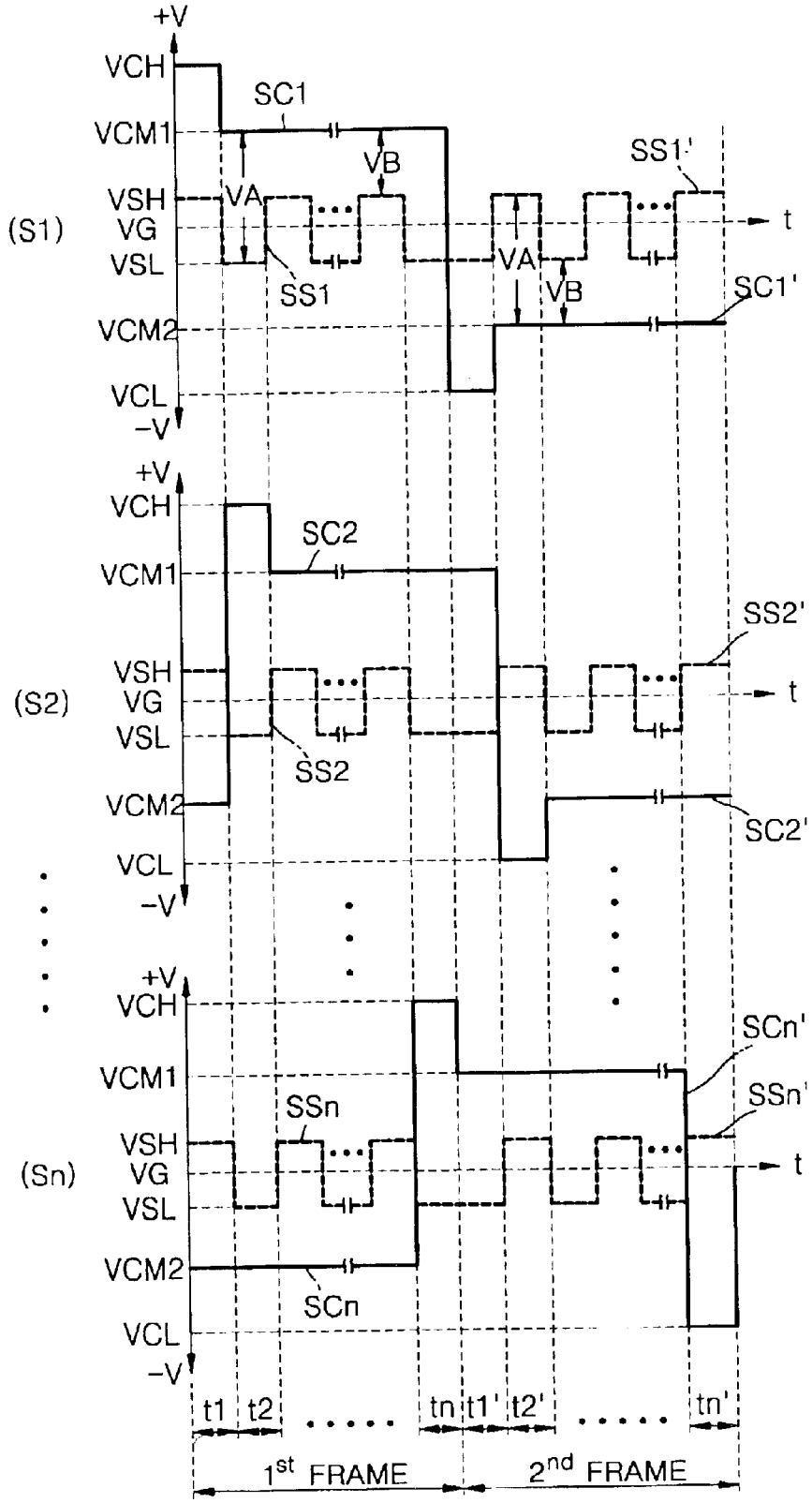
FIG. 3 (PRIOR ART)
FIG. 3 shows the voltage waveforms of scan signals applied to scan electrode lines and the voltage waveforms of display data signals applied to signal electrode lines according to a conventional driving method.
Figure 4:
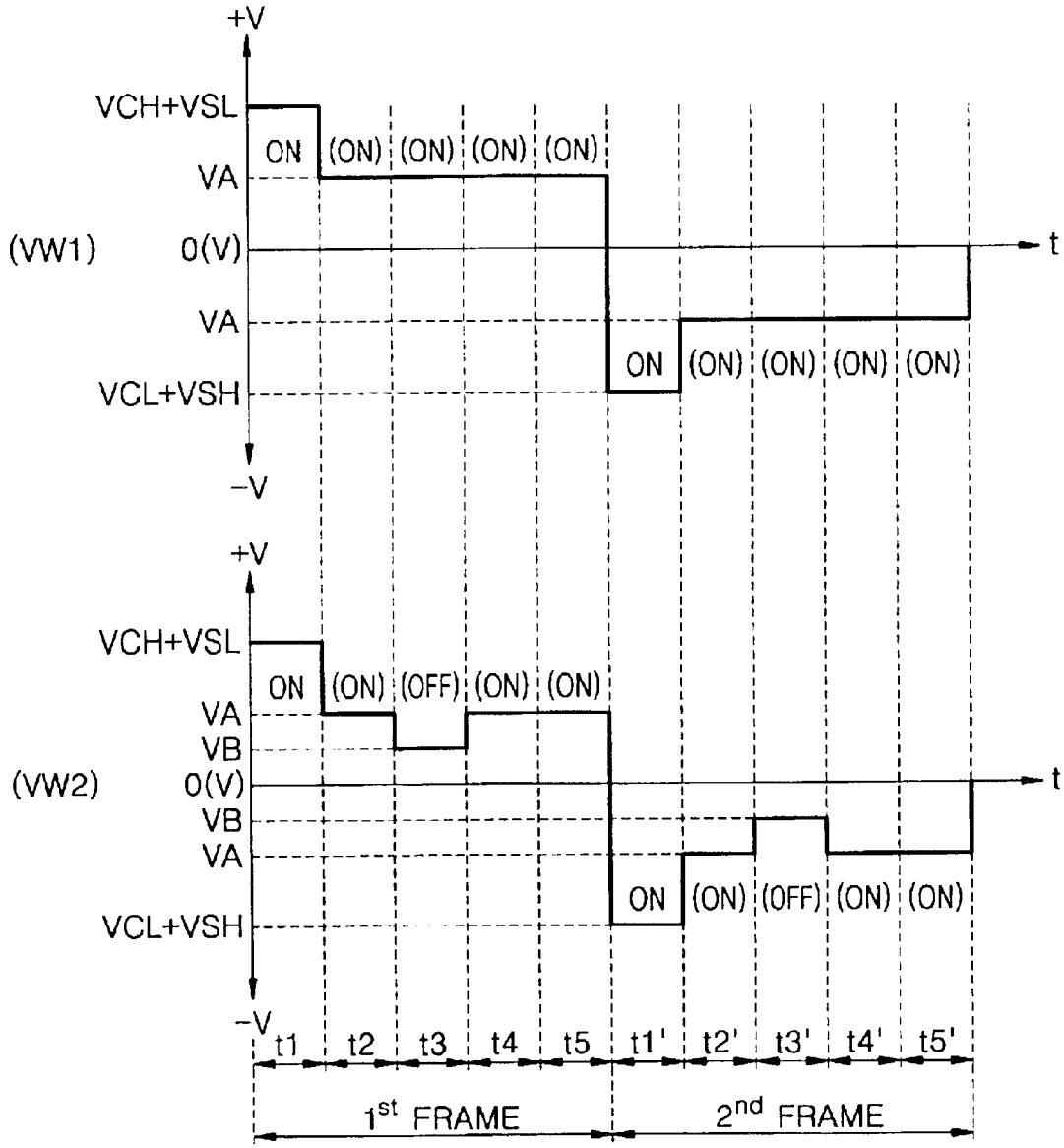
FIG. 4 (PRIOR ART)
FIG. 4 shows the waveforms of voltages applied to two anti-ferroelectric liquid crystal cells on one scan electrode line according to the driving method shown in FIG. 3.
Figure 5:
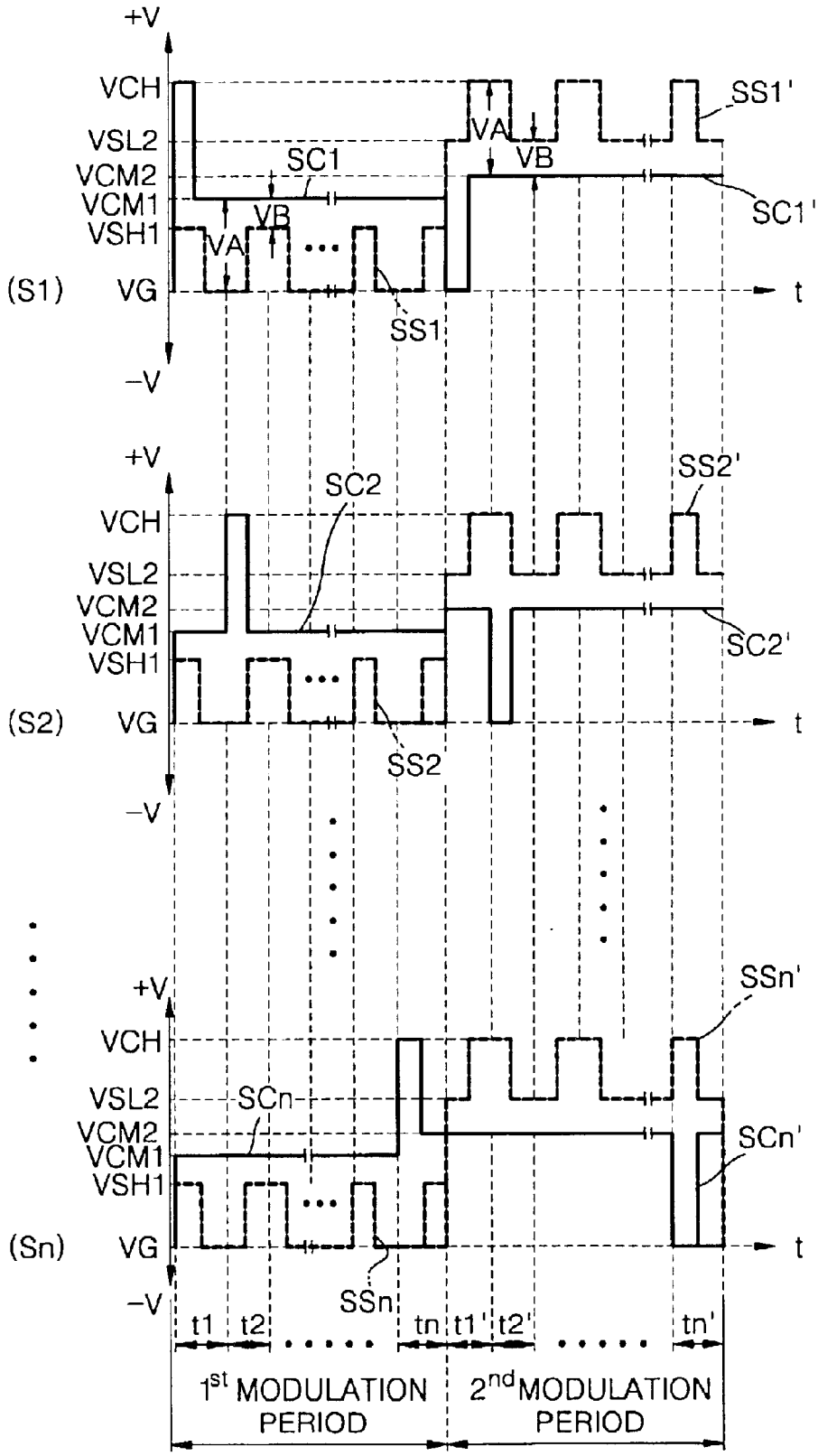
FIG. 5 shows the voltage waveforms of scan signals applied to scan electrode lines and the voltage waveforms of display data signals applied to signal electrode lines according to an embodiment of the present invention.

FIG. 5 shows scan signals SC1, SC2, . . . , SCn, SC1', SC2', . . . , SCn' sequentially applied to the scan electrode lines CL1 through CLn of FIG. 1 and display data signals SS1, SS2, . . . , SSn, SS1', SS2', . . . , SSn' simultaneously applied to the signal electrode lines SL1 through SLm according to an embodiment of the present invention. In FIGS. 3 and 5, the same reference characters denote the same element.

Referring to FIG. 5, in a first modulation period (from t1 through tn in the case of a waveform S1) corresponding to a first driving step, each of the driving periods (t1 through tn) is divided into a scan time (the first half of each driving period t1 through tn) and an inversion time (the last half of each driving period t1 through tn).

Figure 2:
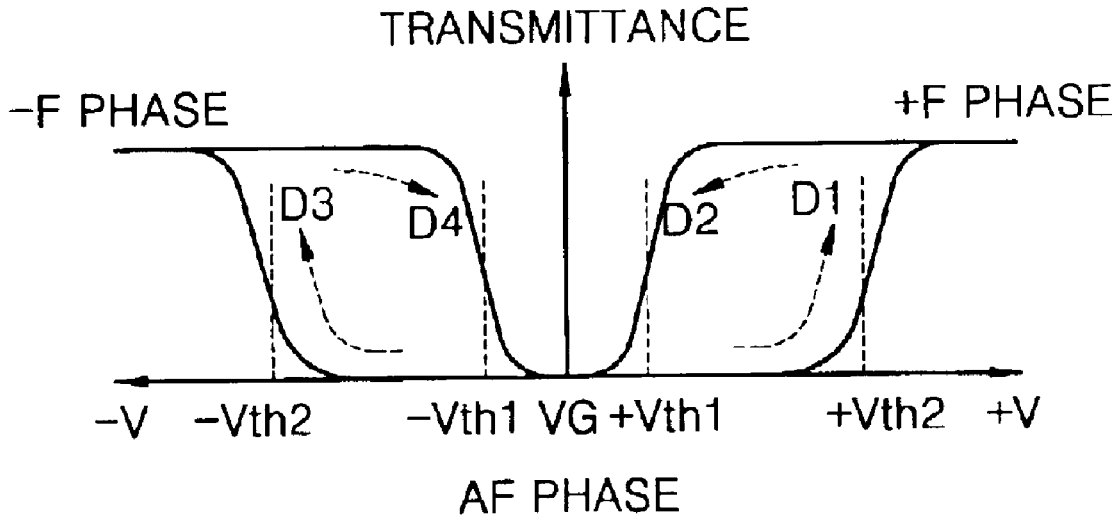
FIG. 2 (PRIOR ART)
FIG. 2 is a graph showing the relationship between voltages applied to anti-ferroelectric liquid crystal cells and transmittance for light in the apparatus shown in FIG. 1.

During the scan times (the first halves) of the respective driving periods t1 through tn, a first scan selection voltage VCH is sequentially applied to the scan electrode lines CL1 through CLn to be scanned, and simultaneously first display data signals SS1 through SSn, having voltages VSH1 and VG lower than the first scan selection voltage VCH, are applied to the signal electrode lines SL1 through SLm. Accordingly, when the first scan selection voltage VCH is applied to one scan electrode line and the second scan selection data voltage VG is applied to selected signal electrode lines, selected anti-ferroelectric liquid crystal cells LC (shown in FIG. 1) are converted into a positive ferroelectric state. Then, external light begins to be transmitted through the selected anti-ferroelectric liquid crystal cells LC (refer to the operation corresponding to the D1 direction of FIG. 2).

During the inversion times (the last halves) of the respective driving periods t1 through tn, a first sustain voltage VCM1, which is lower than the first scan selection voltage VCH and higher than the voltages VSH1 and VG of the first display data signals SS1 through SSn, is applied to the scan electrode CL1 through CLn, which have been scanned, and simultaneously, inverted signals of the first display data signals SS1 through SSn applied during the scan times of the respective driving periods t1 through tn are applied to the signal electrode lines SL1 through SLm.

Accordingly, during one scan time, the first sustain voltage VCM1 is continuously applied to a scan electrode line having selected anti-ferroelectric liquid crystal cells LC, and simultaneously, the first display data signals SS1 through SSn and their inverted signals are continuously applied to the signal electrode lines SL1 through SLm. As a result, the positive ferroelectric state is maintained so that the external light can be continuously transmitted through the selected anti-ferroelectric liquid crystal cells LC (refer to the operation corresponding to the D2 direction of FIG. 2). Here, the average level of voltages applied to each of the signal electrode lines SL1 through SLm is equal to half of a difference between the nonselection data voltage VSH1 and the selection data voltage VG, and is constant. Accordingly, the average level of sustain voltages applied to each of the selected anti-ferroelectric liquid crystal cells LC is constant, so display characteristics of uniform transmittance can be obtained.

In a second modulation period (from t1' through tn' in the case of the waveform S1) corresponding to a second driving step, each of the driving periods (t1' through tn') is divided into a scan time (the first half of each driving period t1' through tn') and an inversion time (the last half of each driving period t1' through tn').

During the scan times (the first halves) of the respective driving periods t1' through tn', a second scan selection voltage VG is sequentially applied to the scan electrode lines CL1 through CLn to be scanned, and simultaneously, second display data signals SS1' through SSn' having voltages VCH and VSL2 higher than the second scan selection voltage VG are applied to the signal electrode lines SL1 through SLm. Accordingly, when the second scan selection voltage VG is applied to one scan electrode line and the selection data voltage VCH is applied to selected signal electrode lines, selected anti-ferroelectric liquid crystal cells LC are converted into a negative ferroelectric state. Then, external light starts to be transmitted through the selected anti-ferroelectric liquid crystal cells LC (refer to the operation corresponding to the D3 direction of FIG. 2).

During the inversion times (the last halves) of the respective driving periods t1' through tn', a second sustain voltage VCM2, which is higher than the second scan selection voltage VG and lower than the voltages VCH and VSL2 of the second display data signals SS1' through SSn', is applied to the scan electrode CL1 through CLn, which have been scanned, and simultaneously, inverted signals of the second display data signals SS1' through SSn' applied during the scan times of the respective driving periods t1' through tn' are applied to the signal electrode lines SL1' through SLm'.

Accordingly, during one scan time, the second sustain voltage VCM2 is continuously applied to a scan electrode line having selected anti-ferroelectric liquid crystal cells LC, and simultaneously, the second display data signals SS1' through SSn' and their inverted signals are continuously applied to the signal electrode lines SL1 through SLm. As a result, the negative ferroelectric state is maintained so that the external light is continuously transmitted through the selected anti-ferroelectric liquid crystal cells LC (refer to the operation corresponding to the D4 direction of FIG. 2). Here, the average level of voltages applied to each of the signal electrode lines SL1 through SLm is equal to half of a difference between the nonselection data voltage VSL2 and the selection data voltage VCH, and is constant. Accordingly, the average level of sustain voltages applied to each of the selected anti-ferroelectric liquid crystal cells LC is constant, so that uniform transmittance display characteristics can be obtained.

During the first modulation period (from t1 through tn in the case of the waveform S1) corresponding to the first driving step and during the second modulation period (from t1' through tn' in the case of the waveform S1) corresponding to the second driving step, the polarities of voltages applied to signal electrode lines and scan electrode lines are constant. The polarity of voltages applied to anti-ferroelectric liquid crystal cells LC during the first modulation period (from t1 through tn in the case of the waveform S1) is opposite to the polarity of voltages applied to anti-ferroelectric liquid crystal cells LC during the second modulation period (from t1' through tn' in the case of the waveform S1). Briefly, the scan selection voltage VCH and the selection data voltage VG during the first modulation period (from t1 through tn in the case of the waveform S1) corresponding to the first driving step are inverted during the second modulation period (from t1' through tn' in the case of the waveform S1) corresponding to the second driving step. Accordingly, the state of anti-ferroelectric liquid crystal cells LC selected during the first modulation period (from t1 through tn in the case of the waveform S1) is inverted at the beginning of the second modulation period (from t1' through tn' in the case of the waveform S1), so the degree of state conversion of the anti-ferroelectric liquid crystal cells LC increases in the second modulation period (from t1' through tn' in the case of the waveform S1) so that the reliability of selection of the anti-ferroelectric liquid crystal cells LC increases.

Figure 6:
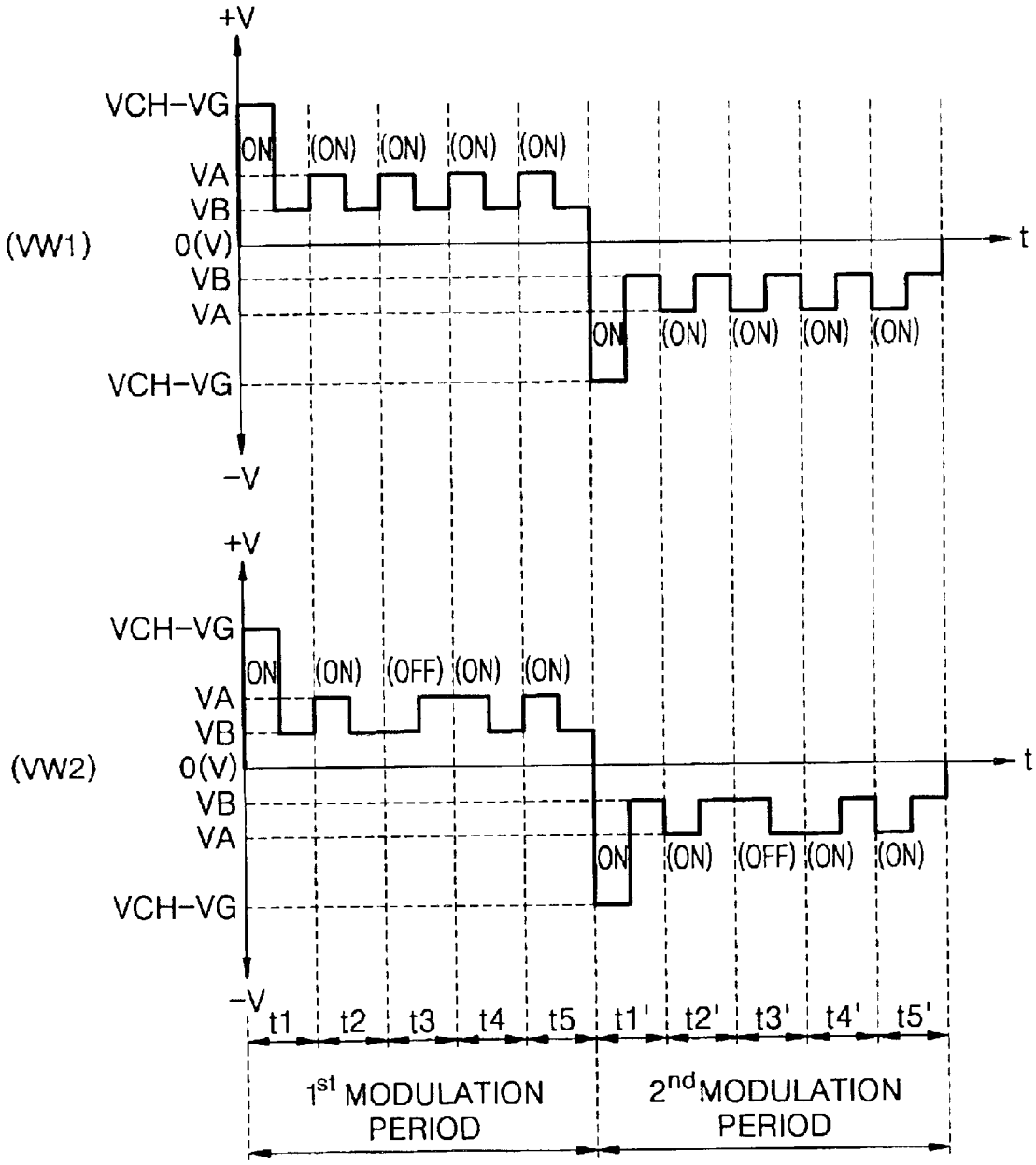
FIG. 6 shows the waveforms of voltages applied to two adjacent anti-ferroelectric liquid crystal cells on one scan electrode line according to the embodiment of FIG. 5.

FIG. 6 shows the waveforms of voltages applied to two anti-ferroelectric liquid crystal cells LC on one scan electrode line according to the driving method of FIG. 5. In FIG. 6, a reference character VW1 denotes the waveform of a voltage applied to a first anti-ferroelectric liquid crystal cell LC. Reference character VW2 denotes the waveform of a voltage applied to a second anti-ferroelectric liquid crystal cell LC on a scan electrode line on which the first reference character VW1 denotes the waveform of a voltage applied to a first anti-ferroelectric liquid crystal cell LC exists. In FIG. 6, it is assumed that a first anti-ferroelectric LCD panel 11 of FIG. 1 is provided with only five scan electrode lines CL1 through CL5. In addition, it is assumed that the first anti-ferroelectric liquid crystal cell LC is defined by the first scan electrode line CL1 and a first signal electrode line SL1, and the second anti-ferroelectric liquid crystal cell LC is defined by the first scan electrode line CL1 and a second signal electrode line SL2.

Referring to FIG. 6, a voltage applied to the first and second anti-ferroelectric liquid crystal cells LC, which are turned ON during a first scan time (the first half of the driving period t1) in the first modulation period (from t1 through tn in the case of the waveform S1) corresponding to the first driving step, has a level VCH−VG equal to a difference between the level of the first scan selection voltage VCH of FIG. 5 and the level of the logic low voltage VG of FIG. 5 of the display data signal. During a following first inversion time (the last half of the driving period t1), due to the inversion of a signal voltage applied to the first signal electrode line SL1, the voltage applied to the first anti-ferroelectric liquid crystal cell LC has a level VB equal to a difference between the level of the first sustain voltage VCM1 and the level of the logic high voltage VSH1 (see the waveform VW1). In a following sustain period ranging from t2 to t5, in the case where four anti-ferroelectric liquid crystal cells LC corresponding to the other scan electrode lines CL2 through CL5 are all turned ON, the voltage applied to the first anti-ferroelectric liquid crystal cell LC has a level VA equal to a difference between the level of the first sustain voltage VCM1 and the level of the logic low voltage VG during the scan times (the first halves of t2 through t5) for the other scan electrode lines CL2 through CL5, and has the level VB equal to a difference between the level of the first sustain voltage VCM1 and the level of the logic high voltage VSH1 during the inversion times (the last halves of t2 through t5) for the other scan electrode lines CL2 through CL5. Accordingly, the average level of the voltage applied to the first anti-ferroelectric liquid crystal cell LC during the sustain period ranging from t2 to t5 is (VA+VB)/2.

Meanwhile, during the first inversion time (the last half of t1) in the first modulation period (from t1 through tn in the case of the waveform S1) corresponding to the first driving step, due to the inversion of a signal voltage applied to the second signal electrode line SL2, the voltage applied to the second anti-ferroelectric liquid crystal cell LC has a level VB. In this case, VB is equal to a difference between the level of the first sustain voltage VCM1 and the level of the logic high voltage VSL (see the waveform VW2). In the following sustain period ranging from t2 to t5, in the case where anti-ferroelectric liquid crystal cells LC scanned during the second, fourth, and fifth scan times (the first halves of t2, t4, and t5) among anti-ferroelectric liquid crystal cells LC on the second signal electrode line SL2 are turned ON, the voltage applied to the second anti-ferroelectric liquid crystal cell LC has the value VA. In this case, VA is equal to the difference between the level of the first sustain voltage VCM1 and the level of the logic low voltage VG during the second, fourth, and fifth scan times (the first halves of t2, t4, and t5) for the second, fourth, and fifth scan electrode lines CL2, CL4, and CL5, and has the level VB equal to the difference between the level of the first sustain voltage VCM1 and the level of the logic high voltage VSH1 during the second, fourth, and fifth inversion times (the last halves of t2, t4, and t5) for the second, fourth, and fifth scan electrode lines CL2, CL4, and CL5. In the case where an anti-ferroelectric liquid crystal cell LC scanned during the third scan time (the first half of t3) among anti-ferroelectric liquid crystal cells LC on the second signal electrode line SL2 is turned OFF, the voltage applied to the second anti-ferroelectric liquid crystal cell LC has the value VB equal to the difference between the level of the first sustain voltage VCM1 and the level of the logic high voltage VSH1 during the third scan time (the first half of t3) for the third scan electrode line CL3, and has the value VA equal to the difference between the level of the first sustain voltage VCM1 and the level of the logic low voltage VG during the third inversion time (the last half of t3) for the third scan electrode line CL3. During the sustain period ranging from t2 to t5, the average level of the voltage applied to the second anti-ferroelectric liquid crystal cell LC is (VA+VB)/2 and is the same as that applied to the first anti-ferroelectric liquid crystal cell LC.

A voltage applied to the first and second anti-ferroelectric liquid crystal cells LC, which are turned ON during a first scan time (the first half of t1') in the second modulation period (from t1' through tn' in the case of the waveform S1) corresponding to the second driving step, has a level VCH−VG equal to a difference between the level of the second scan selection voltage VG of FIG. 5 and the level of the logic high voltage VCH of FIG. 5 of the display data signal. During a following first inversion time (the last half of t1'), due to the inversion of a signal voltage applied to the first signal electrode line SL1, the voltage applied to the first anti-ferroelectric liquid crystal cell LC has a level VB equal to a difference between the level of the second sustain voltage VCM2 and the level of the logic low voltage VSL2 (see the waveform VW1). In a following sustain period ranging from t2' to t5', in the case where four anti-ferroelectric liquid crystal cells LC corresponding to the other scan electrode lines CL2 through CL5 are all turned ON, the voltage applied to the first anti-ferroelectric liquid crystal cell LC has a level VA equal to a difference between the level of the second sustain voltage VCM2 and the level of the logic high voltage VCH during the scan times (the first halves of t2' through t5') for the other scan electrode lines CL2 through CL5, and has the level VB equal to a difference between the level of the second sustain voltage VCM2 and the level of the logic low voltage VSL2 during the inversion times (the last halves of t2' through t5') for the other scan electrode lines CL2 through CL5. Accordingly, the average level of the voltage applied to the first anti-ferroelectric liquid crystal cell LC during the sustain period ranging from t2' to t5' is (VA+VB)/2.

Meanwhile, during the first inversion time (the last half of t1') in the second modulation period (from t1' through tn' in the case of the waveform S1) corresponding to the second driving step, due to the inversion of a signal voltage applied to the second signal electrode line SL2, the voltage applied to the second anti-ferroelectric liquid crystal cell LC has a level VB equal to a difference between the level of the second sustain voltage VCM2 and the level of the logic low voltage VSL2 (see the waveform VW2). In the following sustain period ranging from t2' to t5', in the case where anti-ferroelectric liquid crystal cells LC scanned during the second, fourth, and fifth scan times (the first halves of t2', t4', and t5') among anti-ferroelectric liquid crystal cells LC on the second signal electrode line SL2 are turned ON, the voltage applied to the second anti-ferroelectric liquid crystal cell LC has the value VA equal to the difference between the level of the second sustain voltage VCM2 and the level of the logic high voltage VCH during the second, fourth, and fifth scan times (the first halves of t2', t4', and t5') for the second, fourth, and fifth scan electrode lines CL2, CL4, and CL5, and has the level VB equal to the difference between the level of the second sustain voltage VCM2 and the level of the logic low voltage VSL2 during the second, fourth, and fifth inversion times (the last halves of t2', t4', and t5') for the second, fourth, and fifth scan electrode lines CL2, CL4, and CL5. In the case where an anti-ferroelectric liquid crystal cell LC scanned during the third scan time (the first half of t3') among anti-ferroelectric liquid crystal cells LC on the second signal electrode line SL2 is turned OFF, the voltage applied to the second anti-ferroelectric liquid crystal cell LC has the value VB equal to the difference between the level of the second sustain voltage VCM2 and the level of the logic low voltage VSL2 during the third scan time (the first half of t3') for the third scan electrode line CL3, and has the value VA equal to the difference between the level of the second sustain voltage VCM2 and the level of the logic high voltage VCH during the third inversion time (the last half of t3') for the third scan electrode line CL3. During the sustain period ranging from t2' to t5', the average level of the voltage applied to the second anti-ferroelectric liquid crystal cell LC is (VA+VB)/2 and is the same as that applied to the first anti-ferroelectric liquid crystal cell LC.

As described above, in a method for driving an anti-ferroelectric LCD panel according to an embodiment of the present invention, during an inversion step, the inverted signals of display data signals are applied to signal electrode lines, so the average level of sustain voltages applied to selected anti-ferroelectric liquid crystal cells is constant. Accordingly, uniform transmittance display characteristics can be obtained.

The present invention is not restricted to the above-described embodiments, but the embodiments can be modified and changed by those skilled in the art without departing from the spirit and scope of the invention as defined by the appended claims.

What is claimed is:

1. A method of driving an anti-ferroelectric liquid crystal display panel having signal electrode lines arranged in parallel above anti-ferroelectric liquid crystal cells and at least first and second scan electrode lines arranged below the anti-ferroelectric liquid crystal cells perpendicular to the signal electrode lines, the method comprising a first driving step and a second driving step, which are repeated, and wherein each of the first and second driving steps comprises:

a scanning step comprising applying a scan selection voltage to the first scan electrode line and simultaneously applying display data signals to the signal electrode lines;

an inversion step comprising applying a sustain voltage to the first scan electrode line and simultaneously applying inverted signals of the display data signals which have been applied during the scanning step to the signal electrode lines; and an iteration step comprising repeatedly performing the scanning and inversion steps with respect to the second scan electrode line and to all of the signal electrode lines.

2. The method of claim 1, wherein voltages of the display data signals of the scanning step corresponding to the first driving step are lower than the scanned selection voltage.

3. The method of claim 2, wherein when the scanned selection voltage is applied to one scan electrode line and the voltages of the display data signals are applied to selected signal electrode lines, certain anti-ferroelectric liquid crystal cells are converted into a positive ferroelectric state.

4. The method of claim 3, wherein external light begins to be transmitted through the certain anti-ferroelectric liquid crystal cells when they are converted into a positive ferroelectric state.

5. The method of claim 4, wherein external light is continuously transmitted through the certain anti-ferroelectric liquid crystal cells that are maintained in a positive ferroelectric state.

6. The method of claim 4, wherein an average level of voltages applied to each signal electrode line and an average level of sustained voltages applied to each of the certain anti-ferroelectric liquid crystal cells is constant, so as to produce uniform transmittance display characteristics.

7. The method of claim 1, wherein the sustained voltage of the inversion step corresponding to the first driving step is lower than the scanned selection voltage and higher than the voltages of the display data signals.

8. The method of claim 7, wherein an average level of voltages applied to each signal electrode line and an average level of sustained voltages applied to each of the certain anti-ferroelectric liquid crystal cells is constant, so as to produce uniform transmittance display characteristics.

9. The method of claim 1, wherein voltages of the display data signals of the scanning step corresponding to the second driving step are higher than the scanned selection voltage.

10. The method of claim 9, wherein when the scanned selection voltage is applied to one scan electrode line and the voltages of the display data signals are applied to selected signal electrode lines, certain anti-ferroelectric liquid crystal cells are converted into a negative ferroelectric state.

11. The method of claim 10, wherein external light begins to be transmitted through the certain anti-ferroelectric liquid crystal cells when they are converted into a positive ferroelectric state.

12. The method of claim 11, wherein external light is continuously transmitted through the certain anti-ferroelectric liquid crystal cells that are maintained in a negative ferroelectric state.

13. The method of claim 11, wherein an average level of voltages applied to each signal electrode line and an average level of sustained voltages applied to each of the certain anti-ferroelectric liquid crystal cells is constant, so as to produce uniform transmittance display characteristics.

14. The method of claim 1, wherein polarity of voltages applied to the signal electrode lines and to the first and second scan electrode lines is constant in each of the first and second driving steps, and polarity of voltages applied to the anti-ferroelectric liquid crystal cells during the first driving step is opposite to polarity of voltages applied to the anti-ferroelectric liquid crystal cells during the second driving step.

15. The method of claim 1, wherein the scanning step of the first driving step comprises:

applying a first scan selection voltage to the first scan electrode line and simultaneously applying first display data signals of a voltage lower than the first scan selection voltage to the signal electrode lines, wherein the inversion step of the first driving step comprises:

applying a first sustain voltage, which is lower than the first scan selection voltage and higher than the voltage of the first display data signals, to the first scan electrode line, the scanning step of the second driving step comprises:

applying a second scan selection voltage lower than the first scan selection voltage to the first scan electrode line and simultaneously applying second display data signals of a voltage, which has the same polarity as the first sustain voltage and has a higher level than the first sustain voltage to the signal electrode lines, and the inversion step of the second driving step comprises:

applying a second sustain voltage, which is lower than the voltage of the second display data signals and higher than the second scan selection voltage, to the first scan electrode line.

16. A method of driving an anti-ferroelectric liquid crystal display panel having signal electrode lines arranged in parallel above anti-ferroelectric liquid crystal cells and at least first and second scan electrode lines arranged below the anti-ferroelectric liquid crystal cells perpendicular to the signal electrode lines, the method comprising a first modulation period corresponding to a first driving step and a second modulation period corresponding to a second driving step, which are repeated, and wherein each of the first and second driving steps comprises:

a scanning step comprising applying a scan selection voltage to the first scan electrode line and simultaneously applying display data signals having voltages lower than the scan selection voltage to the signal electrode lines;

an inversion step comprising applying a sustain voltage, that is lower than the scan selection voltage, to the first scan electrode line and simultaneously applying inverted signals of the display data signals, having voltages lower than the sustain voltage which have been applied during the scanning step to the signal electrode lines; and an iteration step comprising repeatedly performing the scanning and inversion steps with respect to the second scan electrode line and to all of the signal electrode lines.

* * * * *